US006230787B1

(12) United States Patent
Koga et al.

(10) Patent No.: US 6,230,787 B1
(45) Date of Patent: May 15, 2001

(54) STACK TYPE EVAPORATOR

(75) Inventors: Yoshiaki Koga; Mitsunari Narahara; Toru Asanuma, all of Tochigi (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/436,491

(22) Filed: Nov. 9, 1999

(30) Foreign Application Priority Data

Nov. 9, 1998 (JP) ..... 10-317145
Jul. 2, 1999 (JP) ..... 11-189273

(51) Int. Cl.[7] ..... F28F 1/00; F28D 1/03
(52) U.S. Cl. ..... 165/41; 165/144; 165/153; 165/176
(58) Field of Search ..... 165/41, 153, 144, 165/176; 62/515

(56) References Cited

U.S. PATENT DOCUMENTS

| | | | | |
|---|---|---|---|---|
| 1,916,549 | | 7/1933 | Young . | |
| 4,809,518 | | 3/1989 | Murayama . | |
| 5,042,577 | * | 8/1991 | Suzumura | 165/153 |
| 5,211,222 | | 5/1993 | Shinmura . | |
| 5,353,868 | | 10/1994 | Abbott . | |
| 6,070,428 | * | 6/2000 | Higashiyama et al. | 165/153 X |

FOREIGN PATENT DOCUMENTS

| | | | | |
|---|---|---|---|---|
| 550 366 | | 3/1986 | (AU) . | |
| 198 14 051 | | 10/1998 | (DE) . | |
| 0 590 306 | | 4/1994 | (EP) . | |
| 0 867 682 | | 9/1998 | (EP) . | |
| 62-00798 | | 1/1987 | (JP) . | |
| 3-186194 | * | 8/1991 | (JP) | 165/153 |
| 7-12778 | | 3/1995 | (JP) . | |
| 2737286 | | 1/1998 | (JP) . | |

* cited by examiner

*Primary Examiner*—Leonard Leo
(74) *Attorney, Agent, or Firm*—Foley & Lardner

(57) ABSTRACT

A stack type evaporator for use in an automotive air conditioner comprises generally a first mass which includes first heat exchanging elements, each first heat exchanging element having mutually independent first and second passages; and a second mass which includes second heat exchanging elements, each second heat exchanging element having a generally U-shaped third passage which has first and second ends. The second mass is arranged beside the first mass in such a manner that the first and second heat exchanging elements are aligned on a common axis. An inlet tank passage connects to upper ends of the first passages. An upstream tank passage connects to lower ends of the first passages and the first ends of the third passages. A downstream tank passage connects to lower ends of the second passages and the second ends of the third passages. An outlet tank passage connects to upper ends of the second passages. An inlet pipe connects to the inlet tank passage. An outlet pipe is connected to the outlet tank passage.

17 Claims, 19 Drawing Sheets

STACK TYPE EVAPORATOR

BACKGROUND OF THE INVENTION

1. Field of the Invention

The present invention relates in general to heat exchangers for use in automotive air conditioners, and more particularly to evaporators of a stack type.

2. Description of the Prior Art

In order to clarify the tasks of the present invention, two conventional stack type evaporators 1 and 1' for automotive air conditioners will be described with reference to FIGS. 24 to 26 and FIGS. 27 to 30.

One of them is shown in FIGS. 24 to 26, which is described in for example Japanese Patent First Provisional Publication 62-798 and Japanese Patent 2,737,286.

As is seen from FIGS. 24 and 25, the first conventional evaporator 1 comprises a core unit 5. Refrigerant inlet and outlet pipes 3 and 4 are fluidly connected to the core unit 5, which are held by a coupler 2. Under operation, a liquid-gaseous refrigerant is led into the core unit 5 through the inlet pipe 3 and evaporates to cool the core unit 5. With this, air flowing through the core unit 5 is cooled. Gaseous refrigerant produced as a result of the evaporation is led into the outlet pipe 4 and into a compressor (not shown). The evaporator 1 is of a so-called "stack type" which comprises a plurality of elongate flat tubes or heat exchanging elements which are stacked, each including two mutually coupled elongate shell plates. Japanese Patent 2737286 shows an alternate arrangement of two areas for the refrigerant, one being a lower temperature area mainly occupied by a liquid refrigerant and the other being a higher temperature area mainly occupied by a gaseous refrigerant. With this alternate arrangement, the evaporator can exhibit a desired temperature distribution thereon.

As is seen from FIG. 25, in assembly of the air conditioner, the evaporator 1 and a heater core 9 are arranged perpendicular to a dash panel 8 by which an engine room 6 and a passenger room 7 are partitioned, and air for conditioning the passenger room is forced to flow in the direction of the arrow "a", that is, in a direction parallel with the dash panel 8. Although not shown in the drawing, a duct is provided in the passenger room 7 to assure such air flow. That is, the evaporator 1 and the heater core 9 are installed in the duct. The coupler 2 is exposed to the engine room 6 through an opening 10 formed in the dash panel 8, so that the evaporator 1 is fluidly connected through pipes to a compressor (not shown) and a condenser (not shown) which are arranged in the engine room 6.

Nowadays, for improving air flow in the passenger room 7, there has been proposed an arrangement wherein, as is seen from FIG. 26, the evaporator 1 and the heater core 9 are arranged in parallel with the dash panel 8, and the air for conditioning the room 7 is forced to flow in the direction of the arrow "b". However, in this case, it becomes necessary to use much longer and complicated pipes as the inlet and outlet pipes 3 and 4 as is easily understood from the drawing. Of course, such arrangement brings about increase in cost of the air conditioner. Furthermore, due to usage of such complicated and longer pipes 3 and 4, the flow resistance of the refrigerant becomes marked and thus the air conditioner fails to exhibit a satisfied performance.

The other conventional stack type evaporator 1' is shown in FIGS. 27 to 30, which is described in for example Japanese Patent First Provisional Publication 62-798 and Japanese Utility Model First Provisional Publication 7-12778.

As is seen from the drawings, the second conventional evaporator 1' comprises a core unit 3'. The core unit 3' comprises a plurality of elongate flat tubes 10' (or heat exchanging elements) which are stacked, each including two mutually coupled elongate shell plates. Each elongate flat tube 10' has two mutually independent flow passages 2' and 2' defined therein. A plurality of heat radiation fins 11' are alternatively disposed in the stacked elongate flat tubes 10'. The two passages 2' and 2' defined in each flat tube 10' have upper and lower tank spaces. By connecting or communicating adjacent flat tubes 10' at the respective upper and lower tank spaces, there are formed a plurality of tank portions 4', 5' and 6'. As is seen from FIGS. 28 to 30, at one end of the core unit 3', there is provided a side tank portion 7' by which the two tank portions 4' and 4' are connected. Under operation, a liquid-gaseous refrigerant is led through an inlet pipe 8' and the inlet tank portion 5' (see FIG. 28) into the core unit 3'. The refrigerant flows in the passages 2' and 2' of the core unit 3' while evaporating to cool the core unit 3'. During this, the refrigerant flows also in the side tank portion 7'. Thus, air flowing through the core unit 3' in the direction of the arrow "α" (see FIGS. 28 to 30) is cooled. Gaseous refrigerant produced as a result of the evaporation is led to an outlet pipe 9' and to a compressor (not shown).

However, the above-mentioned other conventional stack type evaporator 1' has the following drawbacks due to its inherent construction.

First, actually, the side tank portion 7' does not contribute anything to the air cooling because the portion 7' is positioned away from the air passing path. This brings about unsatisfied performance of the air conditioner.

Second, as is seen from FIG. 29, under operation of the evaporator 1', due to the nature of the gravity, the liquid-gaseous refrigerant flowing in the upper tank portions 5' and 4' of the core unit 3' is forced to feed a larger amount of refrigerant to upstream positioned flow passages 2' and 2' and a smaller amount of refrigerant to downstream positioned flow passages 2' and 2'. The amount of the refrigerant in each area of the flow passages 2' and 2' is indicated by the down-pointed arrows in the drawing. While, due to inertia of the refrigerant, the refrigerant flowing in the lower tank portions 4' and 4' of the core unit 3' is forced to feed a smaller amount of refrigerant to upstream positioned flow passages 2' and 2' and a larger amount of refrigerant to downstream positioned flow passages 2' and 2'. The amount of the refrigerant in each area of the flow passages 2' and 2' is indicated by the up-pointed arrows in the drawing. That is, the refrigerant flow rate in the core unit 3' is smaller in the inside portion than the outside portion. Thus, as is seen from FIG. 31, the core unit 3' fails to have a uniformed temperature distribution therethroughout. That is, in the drawing, the outside portions of the core unit 3' indicated by grids are forced to show a low temperature as compared with the inside portions thereof. This means that the air passing through the core unit 3' fails to have a uniformed temperature distribution, which tends to make passengers in the passenger room uncomfortable.

SUMMARY OF THE INVENTION

It is therefore an object of the present invention to provide a stack type evaporator which is free of the above-mentioned drawbacks.

According to a first aspect of the present invention, there is provided a stack type evaporator which comprises a first mass including first heat exchanging elements, each first heat exchanging element having mutually independent first and second passages; a second mass including second heat exchanging elements, each second heat exchanging element having a generally U-shaped third passage which has first and second ends, the second mass being arranged just beside the first mass in such a manner that the first and second heat exchanging elements are aligned on a common axis; an inlet tank passage connecting to upper ends of the first passages; an upstream tank passage connecting to lower ends of the first passages and the first ends of the third passages; a downstream tank passage connecting to lower ends of the second passages and the second ends of the third passages; an outlet tank passage connecting to upper ends of the second passages; an inlet pipe connected to the inlet tank passage; and an outlet pipe connected to the outlet tank passage.

According to a second aspect of the present invention, there is provided an arrangement in a motor vehicle having an engine room and a passenger room which are partitioned by a dash panel. The arrangement comprises an evaporator which includes a first mass including first heat exchanging elements, each first heat exchanging element having mutually independent first and second passages; a second mass including second heat exchanging elements, each second heat exchanging element having a generally U-shaped third passage which has first and second ends, the second mass being arranged just beside the first mass in such a manner that the first and second heat exchanging elements are aligned on a common axis; an inlet tank passage connecting to upper ends of the first passages; an upstream tank passage connecting to lower ends of the first passages and the first ends of the third passages; a downstream tank passage connecting to lower ends of the second passages and the second ends of the third passages; an outlet tank passage connecting to upper ends of the second passages; an inlet pipe connected to the inlet tank passage; and an outlet pipe connected to the outlet tank passage; means for placing the evaporator in such a manner that the evaporator is arranged in parallel with the dash panel and that the inlet tank passage and the upstream tank passage are positioned away from the dash panel as compared with the outlet tank passage and the downstream tank passage; and means for producing an air flow through the evaporator in a direction from the dash panel toward the evaporator.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, the present invention will be described in detail with reference to the accompanying drawings. For ease of understanding, directional terms, such as, right, left, upper, lower and the like are used. However, these directional terms are to be understood with respect to the drawings in which the objective structures or parts are illustrated.

Referring to FIGS. 1 to 13 of the drawings, particularly FIGS. 1, 2, 3, 7 and 10, there is shown a stack type evaporator 100 according to the present invention.

Figure 1:
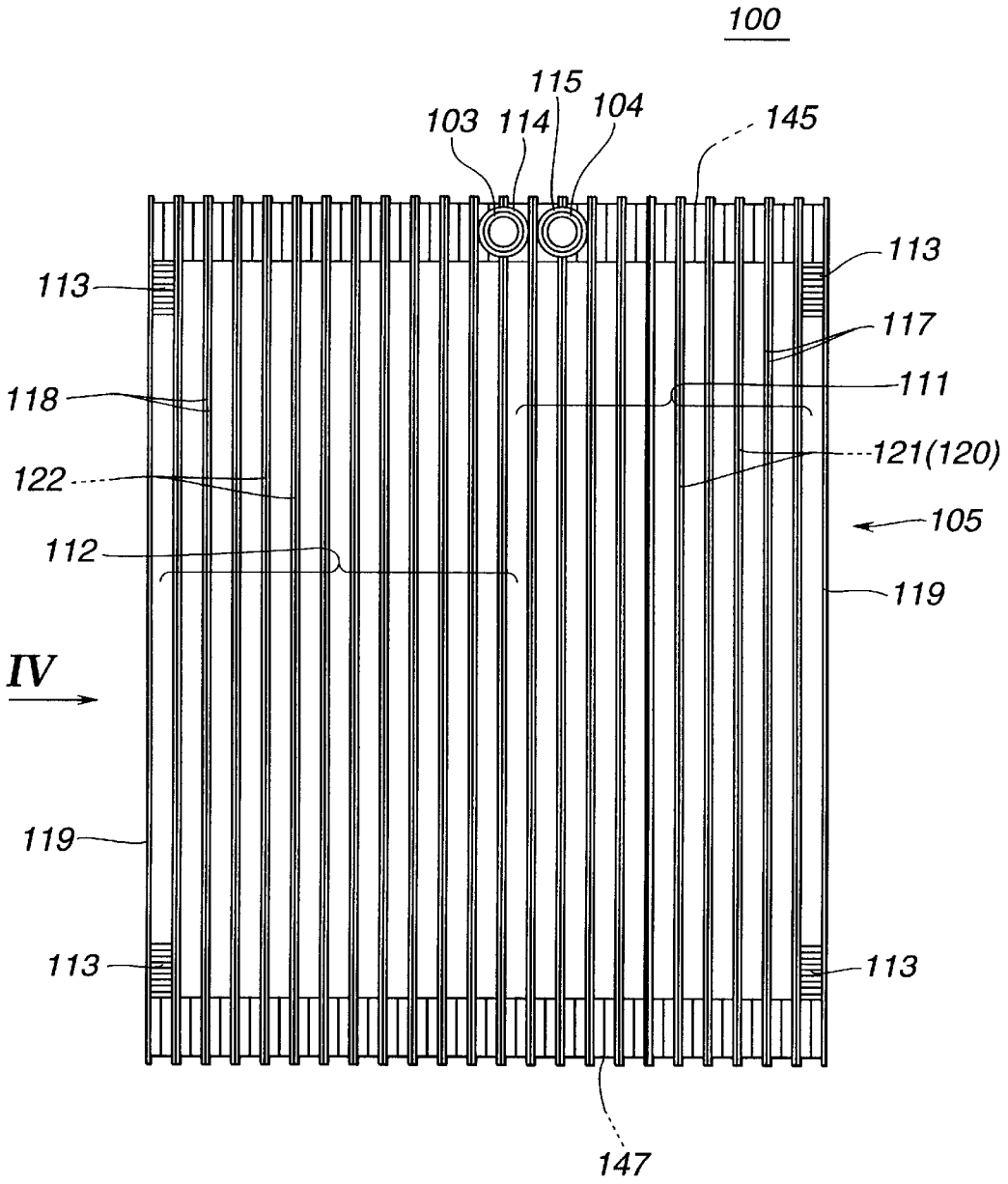
FIG. 1 is front view of a stack type evaporator according to the present invention.
Figure 2:
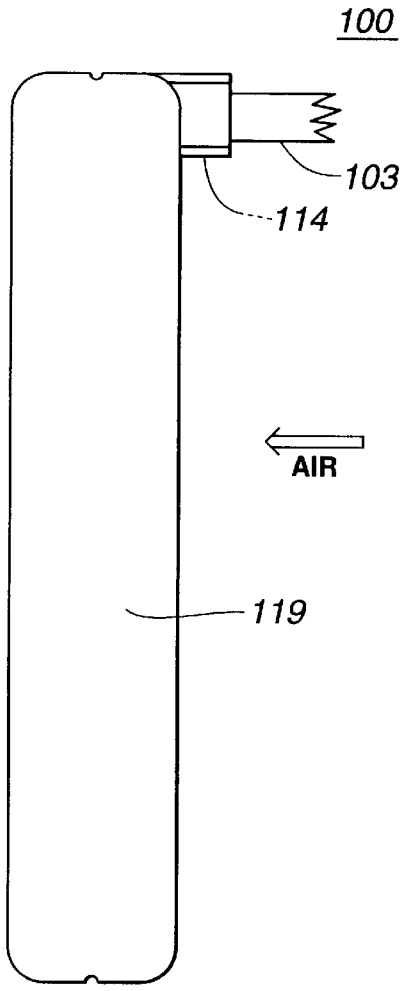
FIG. 2 is a side view of the evaporator of the invention.
Figure 3:
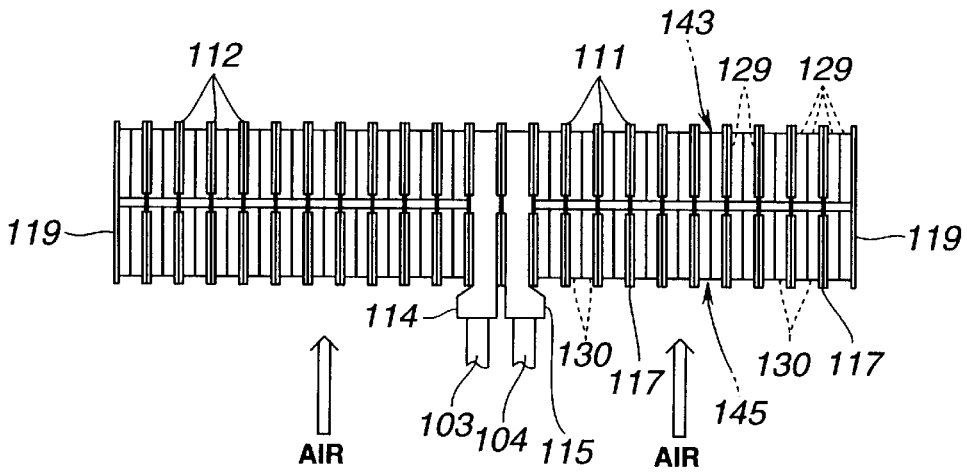
FIG. 3 is a plan view of the evaporator of the invention.

As is seen from FIGS. 1, 2 and 3, the evaporator 100 has a rectangular core unit 105 which comprises a first group of heat exchanging elements 111, a second group of heat exchanging elements 112, and a plurality of hear radiation fins 113 interposed between every adjacent two of the heat exchanging elements 111 and 112. For ease of description, each of the first group of heat exchanging elements 111 will be referred to first heat exchanging element 111, and each of the second group of heat exchanging elements 112 will be referred to second heat exchanging element 112, hereinafter.

As is seen from FIGS. 1, 2 and 3, at an upper middle portion of the core unit 105, there are provided an inlet pipe connector 114 and an outlet pipe connector 115. As is understood from FIG. 2, upon arrangement of the evaporator 100 in an associated automotive air conditioner, the evaporator 100 is so oriented as having the pipe connectors 114 and 115 directed against an air flow. The inlet pipe connector 114 is connected to an inlet pipe 103 through which a liquid-gaseous refrigerant is led into the core unit 105, and the outlet pipe connector 115 is connected to an outlet pipe 104 through which a gaseous refrigerant is discharged from the core unit 105.

Figure 8A:
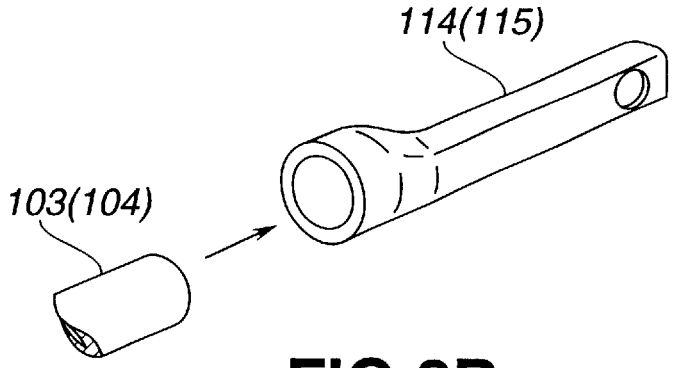
FIGS. 8A and 8B are perspective view of two connector constructions employable in the invention.
Figure 8B:
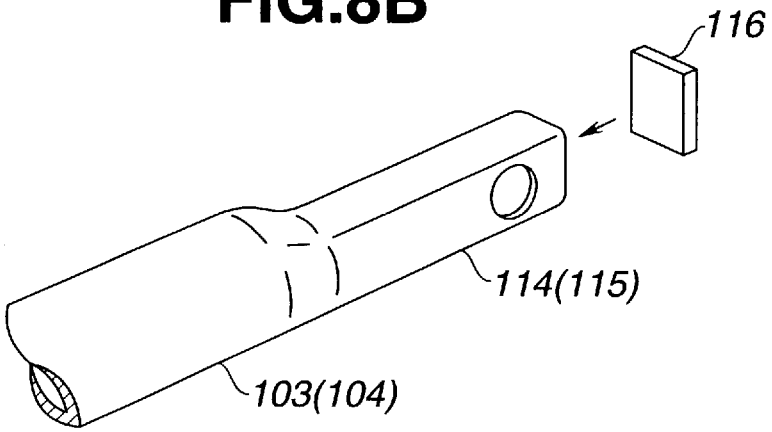

As is seen from FIG. 8A, the inlet pipe connector 114 (or outlet pipe connector 115) has a circular opening with which an end of the inlet pipe 103 (or outlet pipe 104) is engaged and brazed. However, if desired, as is seen from FIG. 8B, the pipe 103 or 104 may have a connector 114 or 115 integrally connected thereto. In this case, a sealing piece 116 is used for shutting the open end of the integrated connector 114 or 115.

Figure 9A:
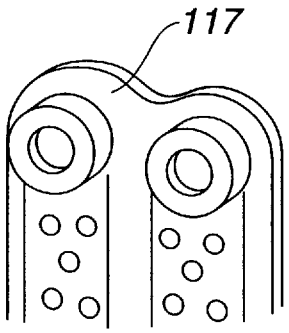
FIGS. 9A, 9B and 9C are perspective views of upper portions of three recessed metal plates each being an essential part of a heat exchanging element, the upper portions having connector structures.
Figure 9B:
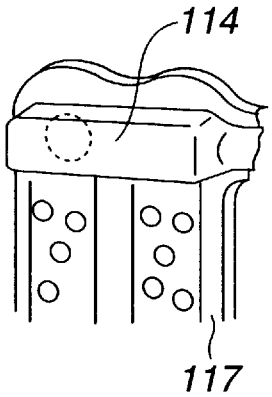
Figure 9C:
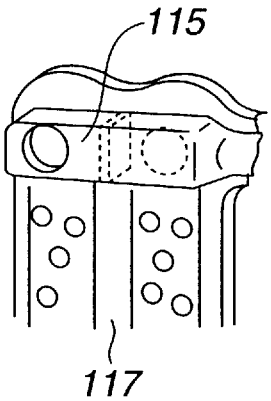

Furthermore, as is seen from FIGS. 9B and 9C, the connector 114 or 115 may be integrated with a recessed metal plate 117 which is a part of an associated heat exchanging element 111 or 112.

Figure 5A:
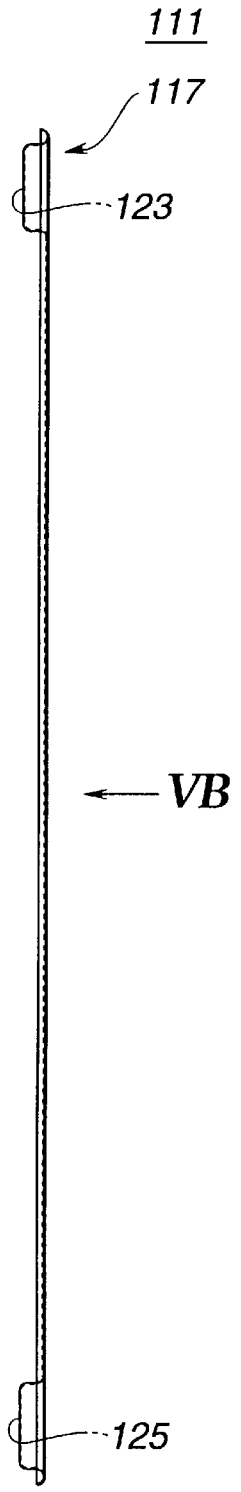
FIG. 5A is a sectional view of the heat exchanging element of FIG. 4A, which is taken from the direction "VA" of FIG. 5B.
Figure 5B:
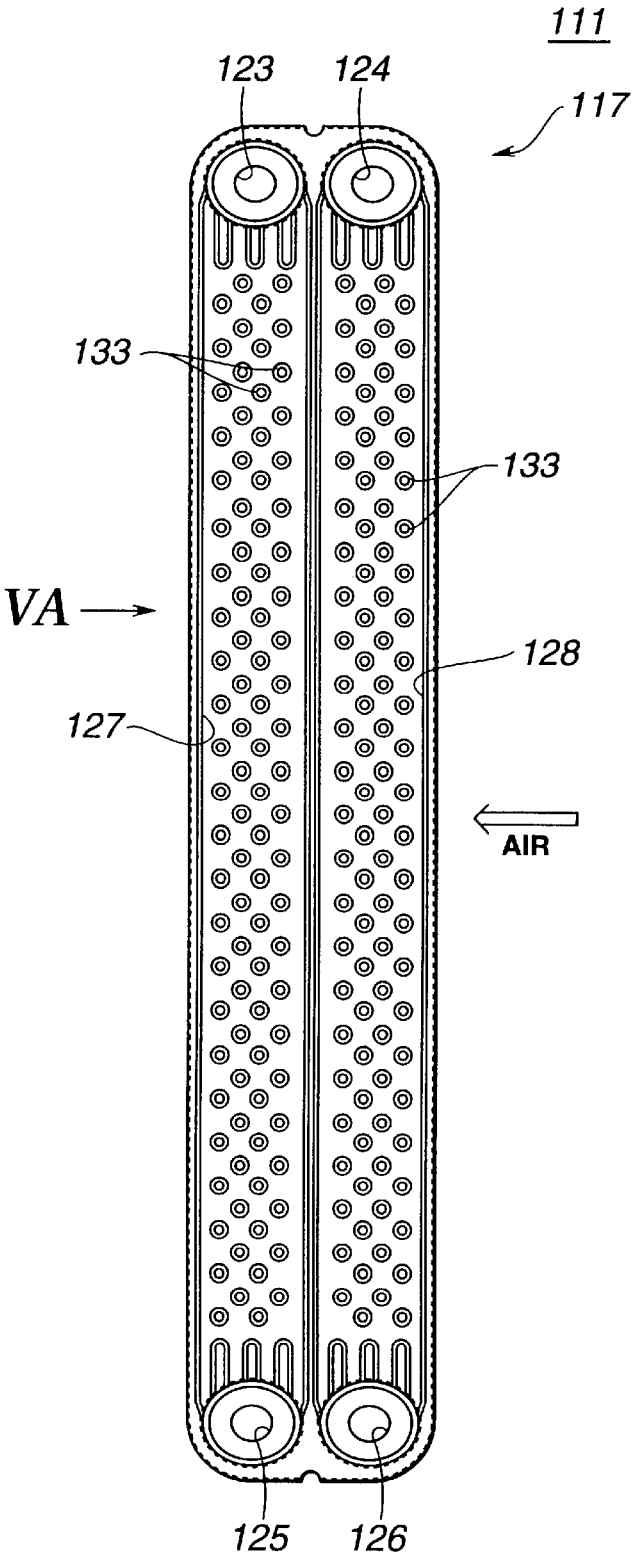
FIG. 5B is a sectional view of the heat exchanging element of FIG. 4A, which is taken from the direction "VB" of FIG. 5A.
Figure 6A:
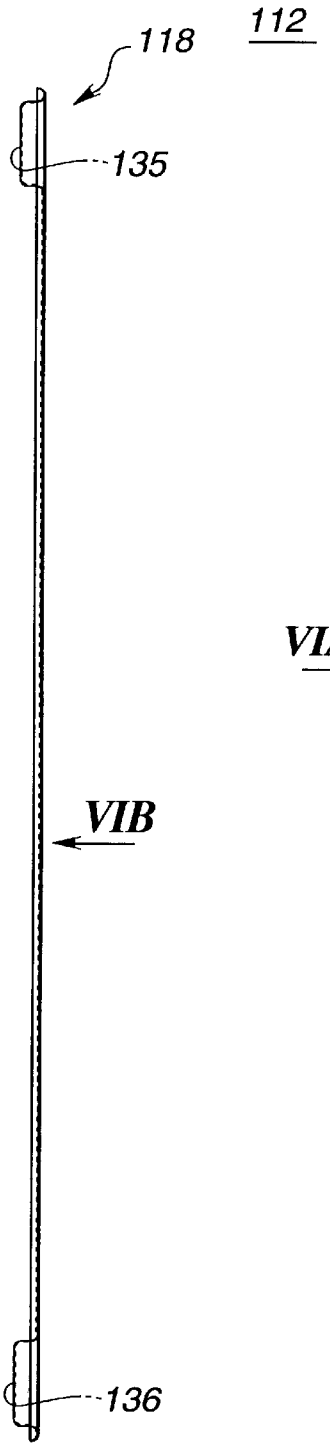
FIG. 6A is a sectional view of the heat exchanging element of FIG. 4B, which is taken from the direction "VIA" of FIG. 6B.
Figure 6B:
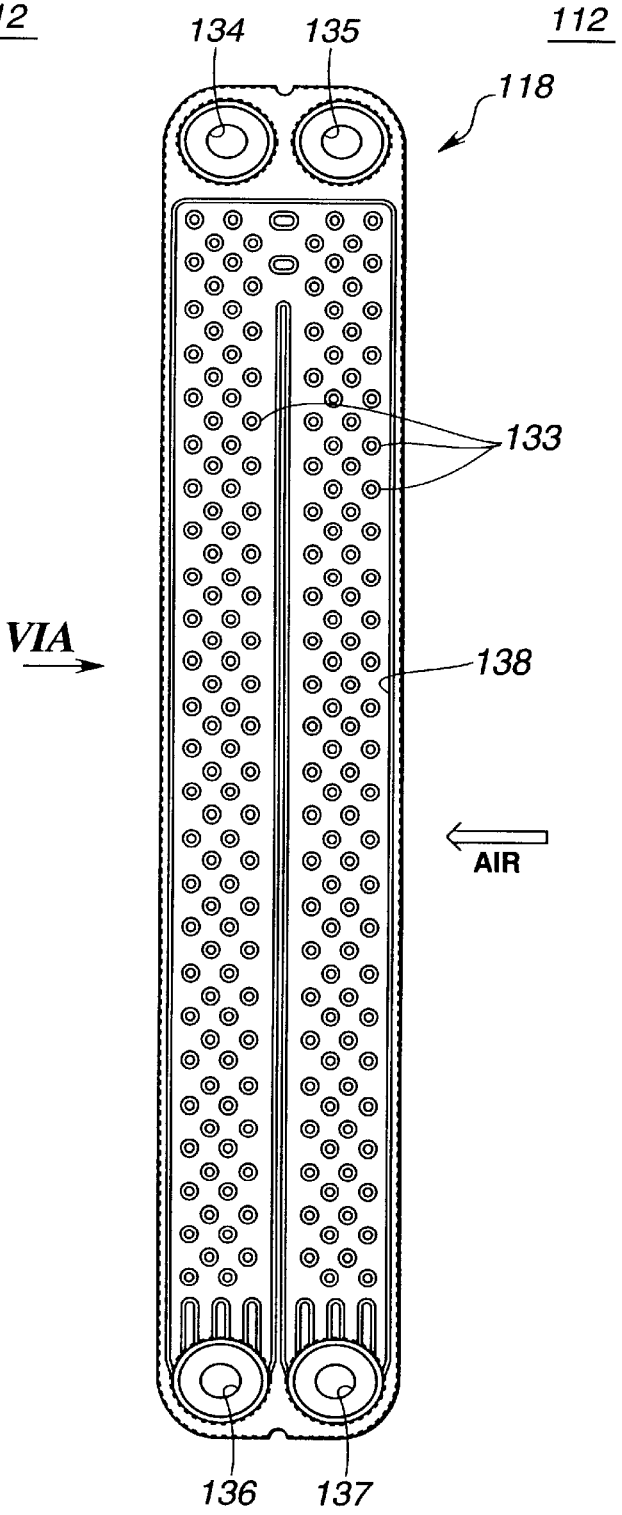
FIG. 6B is a sectional view of the heat exchanging element of FIG. 4B, which is taken from the direction "VIB" of FIG. 6A.

That is, as is shown in FIGS. 5A and 5B, each of the first group of heat exchanging elements 111 comprises two identical recessed metal plates 117, only one being shown in the drawings. As is shown in FIGS. 6A and 6B, each of the second group of heat exchanging elements 112 comprises two identical recessed metal plates 118, only one being shown in the drawings.

The two identical metal plates 117 and 117 (or, 118 and 118) are coupled in a so-called face-to-face connecting manner to define therebetween a hermetically sealed flat flow passage. More specifically, as is understood from FIGS. 4A and 5B, the first heat exchanging element 111 is constructed to have therein two parallel straight flow passages 120 and 121, while, as is understood from FIGS. 4B and 6B, the second heat exchanging element 112 is constructed to have therein a U-shaped flow passage 122, for the reason which will become apparent as the description proceeds.

As will be described hereinafter, one of the first and second recessed metal plates 117 and 118 may have such a structure as shown in FIG. 9A, 9B or 9C. If the structures as shown in FIGS. 9B and 9C are used, reduction in number of parts is achieved because of the integrated formation of the connector 114 or 115.

Each of the recessed metal plates 117 and 118 is a clad metal which includes an aluminum alloy core plate of higher melting point having both surfaces laminated with brazing aluminum alloy plates of lower melting point. Usually, adding silicon (Si) to the aluminum alloy lowers the melting point of the alloy.

For producing the evaporator 100, a plurality of coupled metal plates 117 and 117 for the first group of heat exchanging elements 111, a plurality of coupled metal plates 118 and 118 for the second group of heat exchanging elements 112, a plurality of heat radiation fins 113, inlet and outlet pipe connectors 114 and 115 and a pair of side plates 119 are temporarily assembled in a holder (not shown) in such an arrangement as shown in FIG. 1, and then the temporarily assembled unit is put into a brazing furnace (not shown) for a certain time to braze the parts. With this, the parts 117, 118, 113, 103, 104, 114, 115 and 119 are brazed to one another to constitute a fixed unit of the evaporator 100.

As has been mentioned hereinabove, a right half of the stack type evaporator 100 (see FIG. 1) comprises a plurality of the first heat exchanging elements 111 (viz., first group of heat exchanging elements 111) and associated heat radiation fins 113, and a left half of the evaporator 100 comprises a plurality of the second heat exchanging elements 112 (viz., second group of heat exchanging elements 112) and associated heat radiation fins 113.

Figures 4A, 4B:
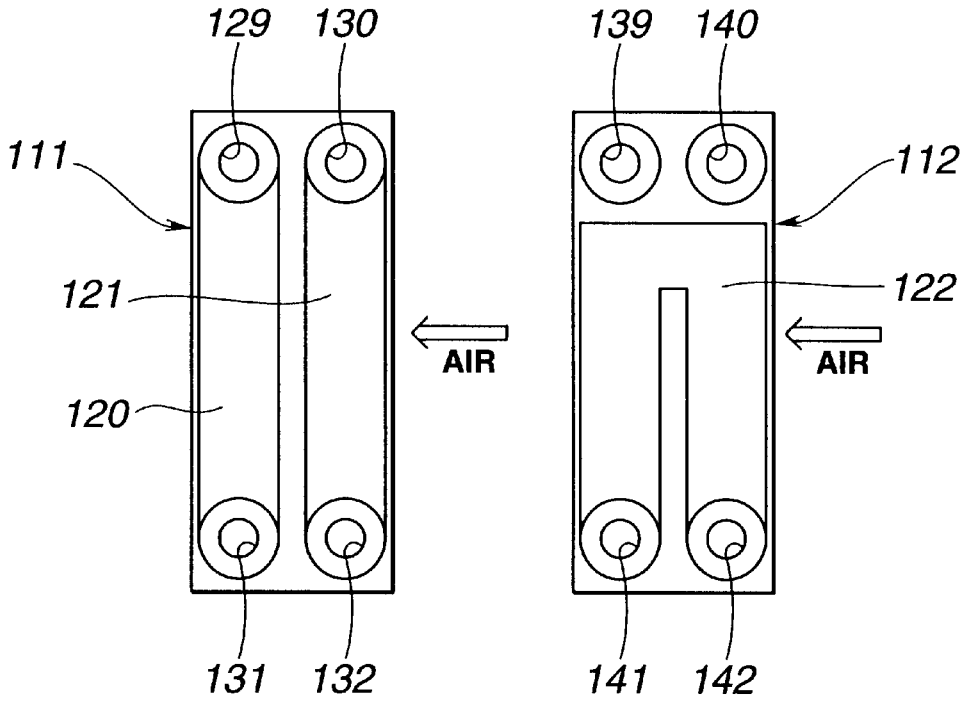
FIG. 4A is a schematic sectional view of one heat exchanging element employed in the evaporator of the invention, which is taken from the direction "IV" of FIG. 1.
FIG. 4B is a view similar to FIG. 4A, but showing another exchanging element employed in the evaporator of the invention.

As is shown in FIG. 4A, each first heat exchanging element 111 has therein two parallel straight flow passages 120 and 121, and as is shown in FIG. 4B, each second heat exchanging element 112 has therein a U-shaped flow passage 122.

As is seen in FIG. 5B, each metal plate 117 for the first heat exchanging element 111 has at an upper end two (viz., first and second) circular openings 123 and 124, and at a lower end two (viz., third and fourth) circular openings 125 and 126, each opening 123, 124, 125 or 126 being defined in a depressed part of the upper or lower end of the plate 117. Furthermore, each metal plate 117 has two parallel shallow grooves 127 and 128 which extend between the openings 123 and 125 and between the openings 124 and 126, respectively. It is to be noted that the shallow groove 127 constitutes the straight flow passage 120 of the first heat exchanging element 111 (see FIG. 4A), and the other shallow groove 128 constitutes the other straight flow passage 121 of the first heat exchanging element 111.

As has been mentioned hereinabove, the two metal plates 117 and 117 are coupled in a face-to-face contacting manner to constitute the first heat exchanging element 111. With this coupling, as is seen from FIG. 4A, the element 111 becomes to have at its upper end two (viz., first and second) tank spaces 129 and 130, and at its lower end two (third and fourth) tank spaces 131 and 132, the first tank space 129 being defined between the opening 123 of the metal plate 117 and the corresponding opening (124) of the partner metal plate 117, the second tank space 130 being defined between the opening 124 of the metal plate 117 and the corresponding opening (123) of the partner metal plate 117, the third tank space 131 being defined between the opening 125 of the metal plate 117 and the corresponding opening (126) of the partner metal plate 117 and the fourth tank space 132 being defined between the opening 126 of the metal plate 117 and the corresponding opening (125) of the partner metal plate 117.

Furthermore, with the coupling between the two metal plates 117 and 117 for constituting the first heat exchanging element 111, there are defined in the element 111 (see FIG. 4A) the two parallel straight flow passages 120 and 121. The passage 120 extends between the first tank space 129 and the third tank space 131, and the other passage 121 extends between the second tank space 130 and the fourth tank space 132.

As is seen from FIG. 5B, bottom surfaces of the two parallel shallow grooves 127 and 128 of each metal plate 117 are formed with a plurality of studs 133. Upon coupling between the paired metal plates 117 and 117, the studs 133 of one metal plate 117 abut against the studs 133 of the partner's metal plate 117 respectively. These abutting studs 133 become brazed when heated in the brazing furnace. Due to provision of such studs 133, the coupling between the paired metal plates 117 and 117 is assured and the refrigerant flow in the two flow passages 120 and 121 is suitably diffused.

As is seen in FIG. 6, each metal plate 118 for the second heat exchanging element 112 has an upper end two (fifth and sixth) circular openings 134 and 135, and at a lower end two (viz., seventh and eighth) circular openings 136 and 137, each opening 134, 135, 136 or 137 being defined in a depressed part of the upper and lower end of the plate 118. Furthermore, each metal plate 118 has a U-shaped shallow groove 138 which comprises two parallel shallow groove parts (no numerals) each having one end connected to the seventh or eighth circular opening 136 or 137 and a short shallow groove part (no numeral) connecting the other ends of the two parallel shallow groove parts. It is to be noted that U-shaped shallow groove 138 constitutes the U-shaped flow passage 121 of the second heat exchanging element 112 (see FIG. 4B).

As has been mentioned hereinabove, the two metal plates 118 and 118 are coupled in a face-to-face contacting manner to constitute the second heat exchanging element 112. With this coupling, as is seen from FIG. 4B, the element 112 becomes to have at its upper end two (viz., fifth and sixth) tank spaces 139 and 140, and at its lower end two (viz., seventh and eighth) tank spaces 141 and 142, the fifth tank space 139 being defined between the opening 134 of the metal plate 118 and the corresponding opening (135) of the partner metal plate 118, the sixth tank space 140 being defined between the opening 135 of the metal plate 118 and the corresponding opening (134) of the partner metal plate 118, the seventh tank space 141 being defined between the opening 136 of the metal plate 118 and the corresponding opening (137) of the partner metal plate 118 and the eighth tank space 142 being defined between the opening 137 of the metal plate 118 and the corresponding opening (136) of the partner metal plate 118.

Furthermore, with the coupling between the two metal plates 118 and 118 for constituting the second heat exchanging element 112, there are defined in the element 112 (see FIG. 4B) the U-shaped flow passage 122. This passage 122 extends between the seventh and eighth tank spaces 141 and 142. It is to be noted that the passage 122 is isolated from the fifth and sixth tank spaces 139 and 140, as is seen from the drawing (FIG. 4B).

As is seen from FIG. 6B, a bottom surface of the U-shaped shallow groove 138 of each metal plate 118 is formed with a plurality of studs 133. Upon coupling between the paired metal plates 118 and 118, the studs 133 of one metal plate 118 abut against the studs 133 of the partner's metal plate 118 respectively. The abutting studs 133 become brazed when heated in the brazing furnace. If desired, the fifth and sixth tank spaces 139 and 140 may be removed. However, in this case, it becomes necessary to provide between the upper ends of any adjacent two of the second heat exchanging elements 112 and 112 a distance keeping element.

Figure 7:
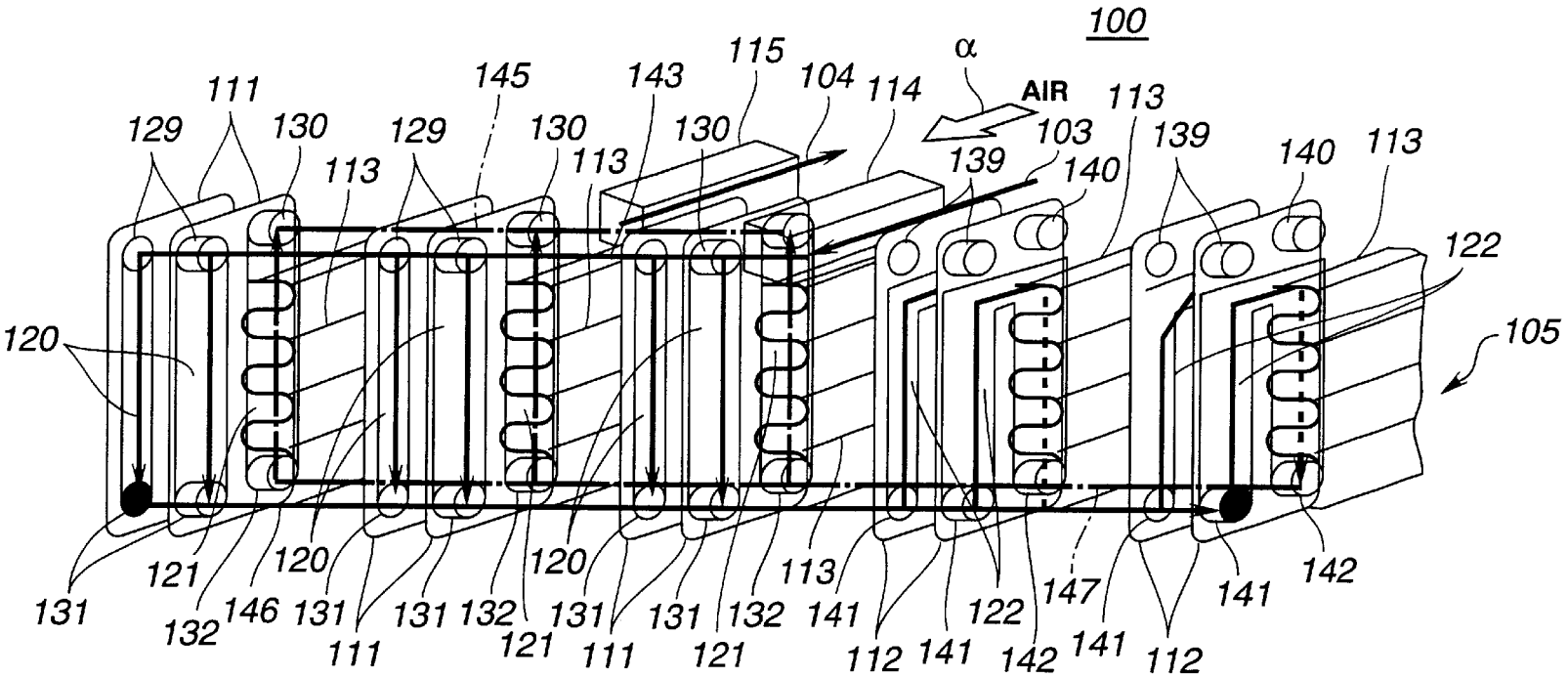
FIG. 7 is a schematically illustrated perspective view of the evaporator of the invention, showing the path of refrigerant.

As is seen from FIGS. 3 and 7, upon assembly of the evaporator 100, the first tank spaces 129 of the first heat exchanging elements 111 are aligned and connected to one another to constitute an inlet tank portion 143. The inlet tank portion 143 is connected through the inlet pipe connector 114 to the inlet pipe 103. It is to be noted that the rightmost one of the first metal plates 117 as viewed in FIGS. 1 and 3 has no opening corresponding to the opening 123 (see FIG. 5B).

Furthermore, as is seen from FIGS. 3 and 7, upon assembly of the evaporator 100, the second tank spaces 130 of the first heat exchanging elements 111 are aligned and connected to one another to constitute an outlet tank portion 145. The outlet tank portion 145 is connected through the outlet pipe connector 115 to the outlet pipe 104. It is to be noted that the rightmost one of the first metal plates 117 as viewed in FIGS. 1 and 3 has no opening corresponding to the opening 124 (see FIG. 5B).

As is seen from FIG. 7, upon assembly, the third tank spaces 131 of the first heat exchanging elements 111 and the seventh tank spaces 141 of the second heat exchanging elements 112 are aligned and connected to one another to constitute a refrigerant flow upstream tank portion 146. It is to be noted that the rightmost one of the second metal plates 118 as viewed in FIG. 7 has no opening corresponding to the opening 136 and the leftmost one of the first metal plates 117 has no opening corresponding to the opening 125.

Furthermore, as is seen from FIG. 7, upon assembly, the fourth tank spaces 132 of the first heat exchanging elements 111 and the eighth tank spaces 142 of the second heat exchanging elements 112 are aligned and connected to one another to constitute a refrigerant flow downstream tank portion 147. It is to be noted that the rightmost one of the second metal plates 118 as viewed in FIG. 7 has no opening corresponding to the opening 137 and the leftmost one of the first metal plates 117 has no opening corresponding to the opening 126.

In the following, operation of the stack type evaporator 100 of the invention will be described with reference to FIGS. 7 and 10.

Under operation of the associated air conditioner, a liquid-gaseous refrigerant, which has been discharged from an expansion valve (not shown), is led into the inlet tank portion 143 through the inlet pipe connector 114 and the inlet pipe 103. The refrigerant in the inlet tank portion 143 then flows down into the straight flow passages 120 of the first group heat exchanging elements 111 which are arranged at the left-half (as viewed in FIG. 7) and air downstream side of the core unit 105 of the evaporator 100. The refrigerant in the straight flow passages 120 then flows into a left half part (as viewed in FIGS. 7 and 10) of the refrigerant flow upstream tank portion 146.

The refrigerant led into the left-half part of the refrigerant flow upstream tank portion 146 flows in the portion 146 rightward in the drawing. Then, the refrigerant is led into the U-shaped flow passages 122 of the second group heat exchanging elements 112 which constitute the right-half part of the core unit 105 in the drawings. The refrigerant in the U-shaped flow passages 122 then flows into a right half part of the refrigerant flow downstream tank portion 147. Then, the refrigerant flows leftward (as viewed in FIGS. 7 and 10) in the tank portion 147 and then flows upward into the straight flow passages 121 of the first groups heat exchanging elements 111. The refrigerant then flows into the outlet tank portion 145 and then flows into a compressor through the outlet pipe connector 115 and the outlet pipe 104.

During the above-mentioned flow in the core unit 105, the refrigerant makes a heat exchanging with the air which flows through the core unit 105 in the direction of the arrow "α" of the drawings. Thus, the air is cooled by a certain degree.

Figure 10:
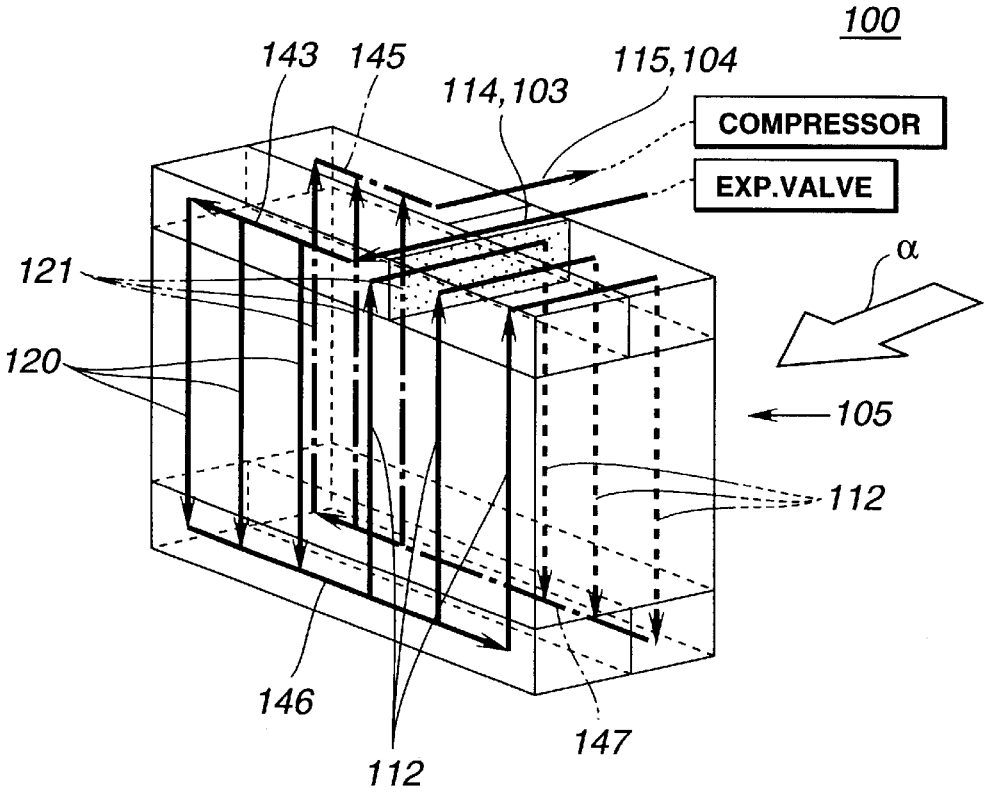
FIG. 10 is a schematically illustrated perspective view of the evaporator of the invention, showing the path of refrigerant in the evaporator.
Figure 11:
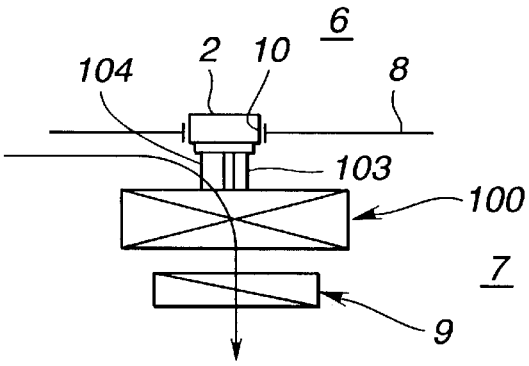
FIG. 11 is a schematic plan view of a part of a motor vehicle where the evaporator of the invention associated with an air conditioner is operatively arranged.

As is easily understood from FIG. 10, due to the above-mentioned unique arrangement of the refrigerant flow passages, the refrigerant can flow evenly in both the air flow downstream part and the air flow upstream part of the core unit 105. That is, the flow passages 120 through which the lowest temperature refrigerant flows are arranged just behind the flow passages 121 through which the highest temperature refrigerant flows, and the intermediate temperature refrigerant flows in the U-shaped flow passages 122 which extend between the air flow upstream and downstream parts of the core unit 105.

Figure 12:
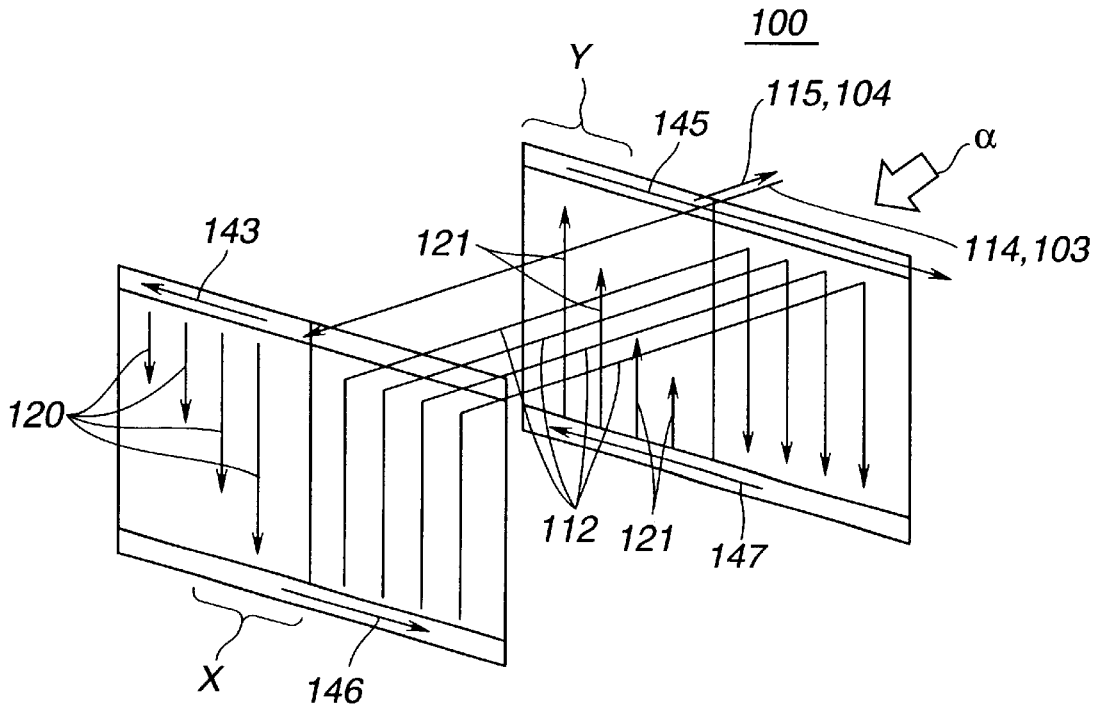
FIG. 12 is a schematic perspective view of the evaporator of the invention, showing the flow condition of refrigerant in the evaporator.
Figure 13:
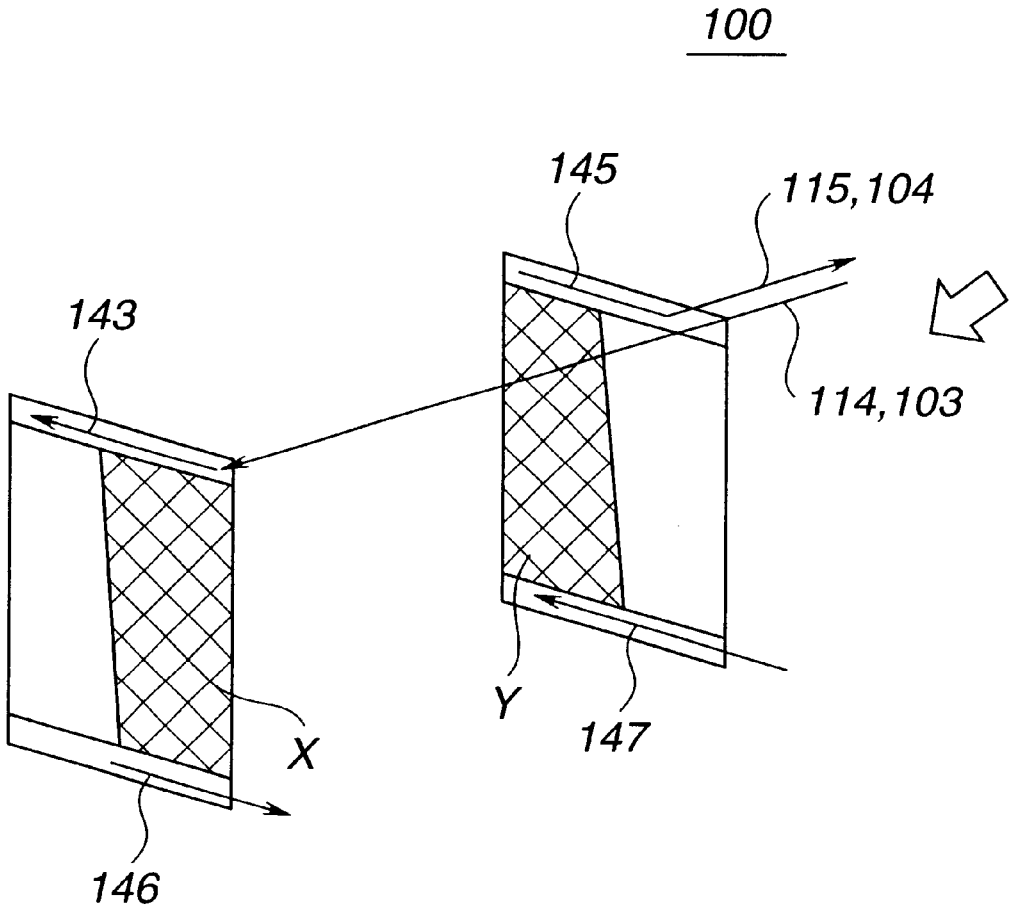
FIG. 13 is a schematic view of the evaporator of the invention, showing a temperature distribution possessed by the evaporator.

Furthermore, as is understood from FIGS. 12 and 13, under operation, the inside side section "X" of the air flow downstream left-half part of the evaporator 100 is permitted to let a larger amount of liquid-gaseous refrigerant flow therethrough, and the outside section "Y" of the air flow upstream left-half part of the evaporator 100 is permitted to let a larger amount of gaseous refrigerant flow therethrough. It is to be noted that these two sections "X" and "Y" are not overlapped with respect to the direction in which the air "α" flows. This means that a relatively low temperature zone of the flow passages 120 and a relatively high temperature zone of the flow passages 121 are overlapped to each other with respect to the air flowing direction.

Thus, the core unit 105 of the evaporator 100 can have an even temperature distribution therethroughout. This provides the air passing through the core unit 105 with a uniformed temperature distribution, which makes the passengers comfortable. Furthermore, such even temperature distribution of the core unit 105 brings about an effective heat exchanging between the refrigerant flowing in the core unit 105 and the air passing through the core unit 105.

In each of the right and left half parts (as viewed in FIGS. 7 and 10) of the core unit 105, higher temperature refrigerant flows in the air flow upstream part of the core unit 105 and lower temperature refrigerant flows in the air flow downstream part of the unit 105. This promotes the uniformed temperature distribution of the air passing through the core unit 105.

As is described hereinabove, the evaporator 100 of the present invention is so oriented as having the pipe connectors 114 and 115 directed against the air flow. Thus, as is seen from FIG. 11, even when the evaporator 100 is arranged in parallel with the dash panel 8, the connection of the inlet and outlet pipes 103 and 104 to the coupler 2 held by the dash panel 8 is readily and simply made, which brings about a low cost production of the automotive air conditioner as well as a smoothed air flow passing through the evaporator 100.

Figure 28:
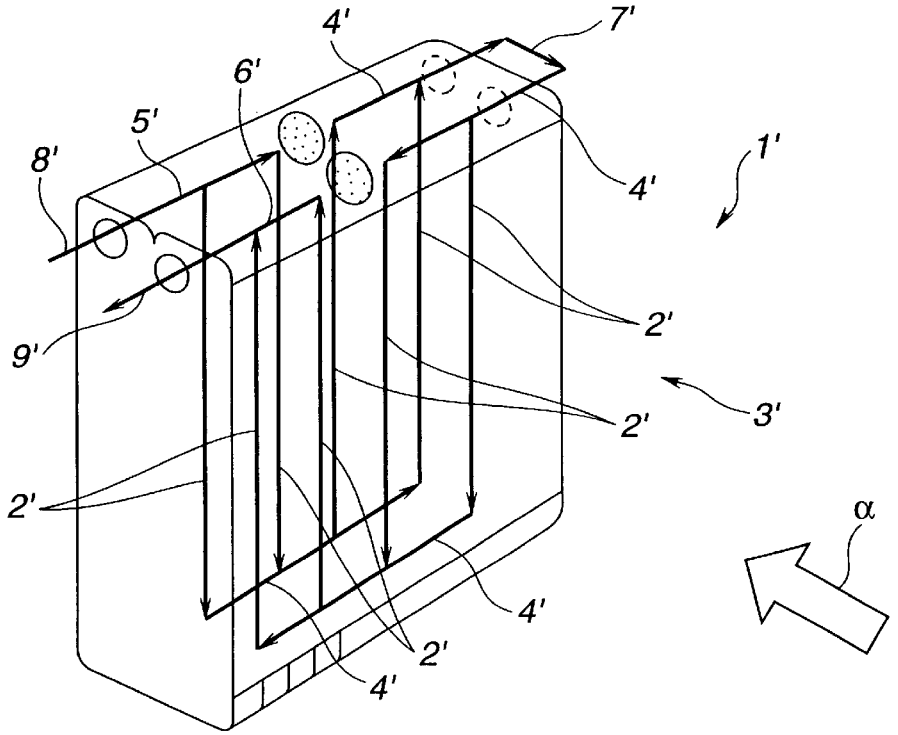
FIG.28 (PRIOR ART)
FIG. 28 is a schematic perspective view of the second conventional evaporator, showing the path of refrigerant in the evaporator.
Figure 29:
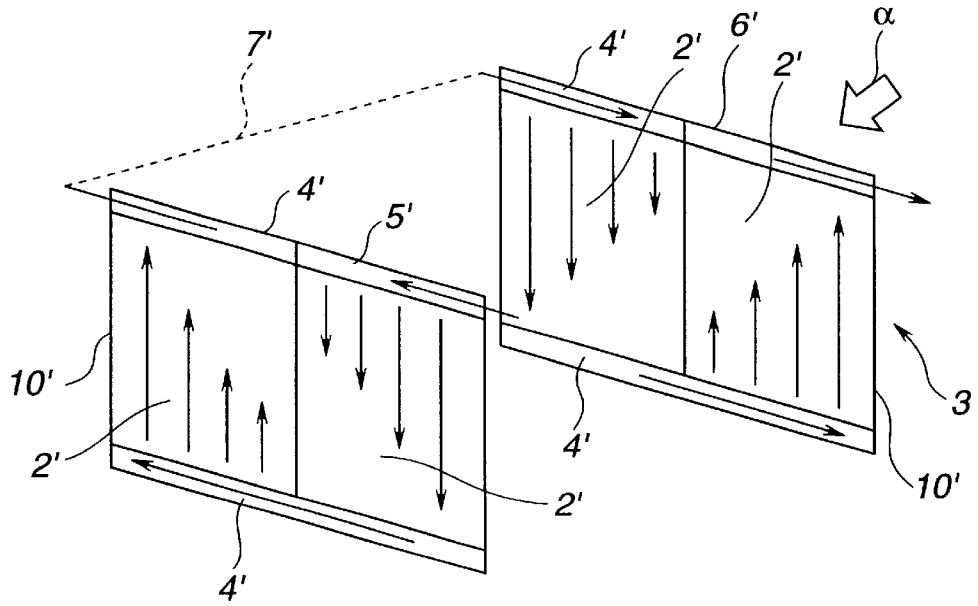
FIG.29 (PRIOR ART)
FIG. 29 is a schematic perspective view of the second conventional evaporator, showing flow condition of refrigerant in the evaporator.
Figure 30:
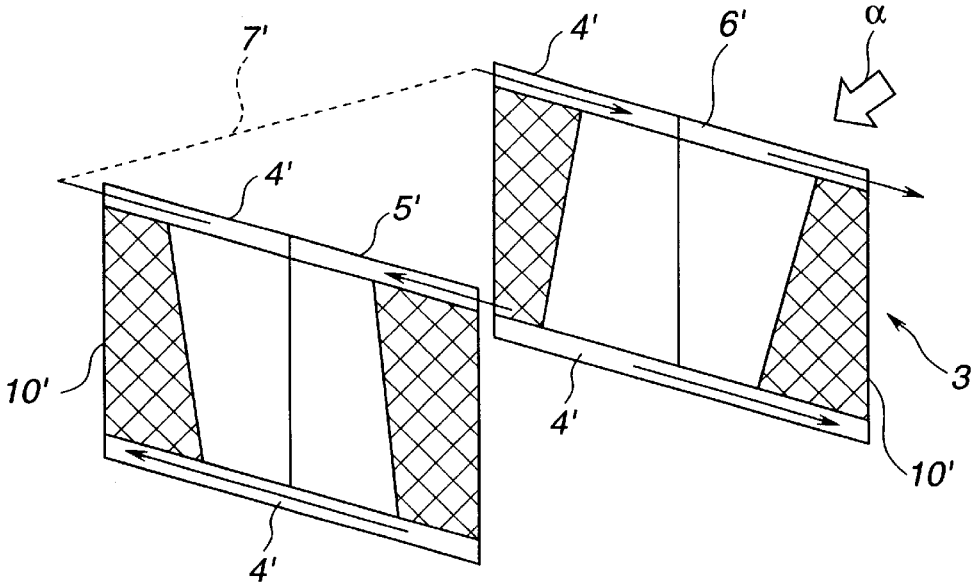
FIG.30 (PRIOR ART)
FIG. 30 is a schematic view of the second conventional evaporator, showing a temperature distribution possessed by the evaporator.

Furthermore, since the evaporator 100 has no structure corresponding the side tank portion 7' (see FIG. 28) possessed by the conventional evaporator 1', lowering in heat exchanging performance caused by such side tank portion 7' does not occur.

Figure 14:
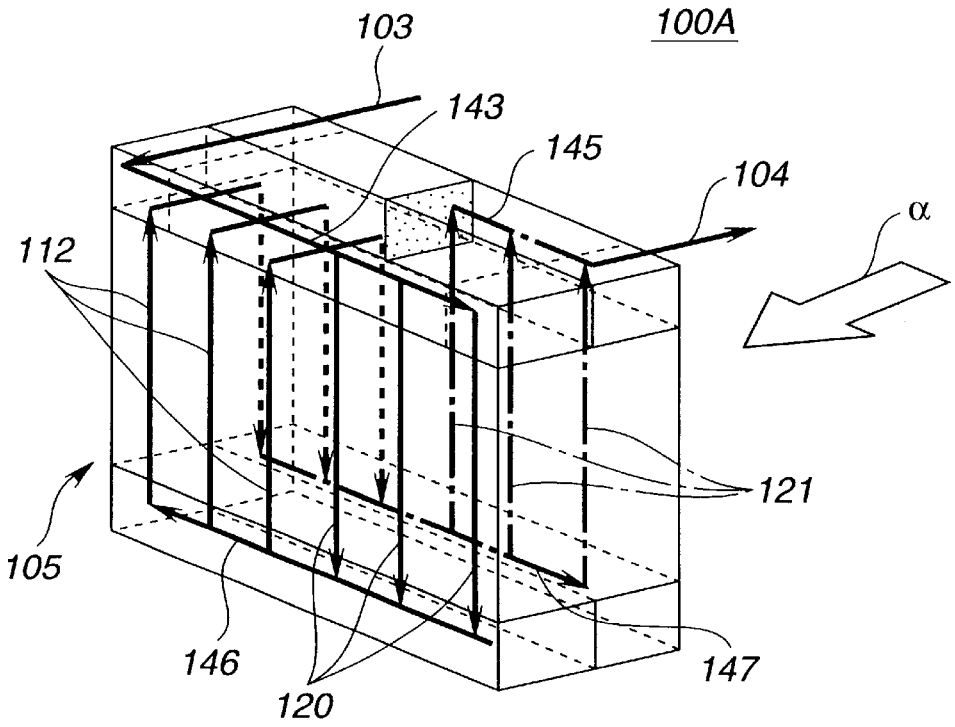
FIG. 14 is a view similar to FIG. 10, but showing a first modification of the evaporator of the present invention.
Figure 15:
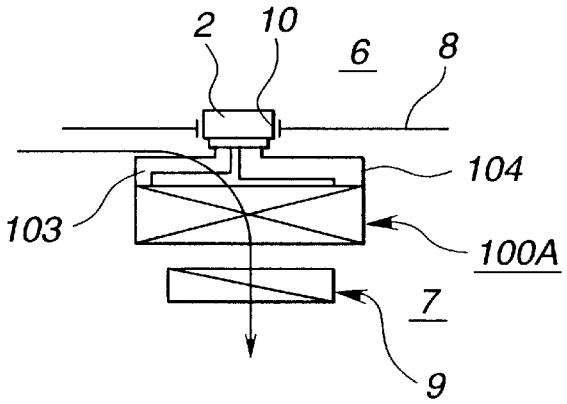
FIG. 15 is a schematic plan view of a part of a motor vehicle where the first modification of the evaporator associated with an air conditioner is operatively arranged.

Referring to FIGS. 14 and 15, there is shown a first modification 100A of the evaporator 100.

In this first modification 100A, the inlet pipe 103 is connected to a left end portion (as viewed in FIG. 14) of the core unit 105, and the outlet pipe 104 is connected to a right end portion (as viewed in FIG. 14) of the core unit 105. For this arrangement, the inlet tank portion 143 extends throughout the width of the core unit 105, as shown. That is, in this modification 100A, the first tank spaces 129 (see FIG. 7) of the first heat exchanging elements 111 and the fifth tank spaces 139 of the second heat exchanging elements 112 are connected to constitute the inlet tank portion 143. The outlet tank portion 145 is arranged at a right half air flow upstream side of the core unit 105, as shown in the drawing.

As is seen from FIG. 15, even when the modified evaporator 100A is arranged in parallel with the dash panel 8, the connection of the inlet and outlet pipes 103 and 104 to the coupler 2 is readily and simply made, which brings about a low cost production of the automotive air conditioner and a smoothed air flow passing through the evaporator 100A.

Referring to FIGS. 16 to 21, there is shown a second modification 100B of the evaporator 100.

Figure 16:
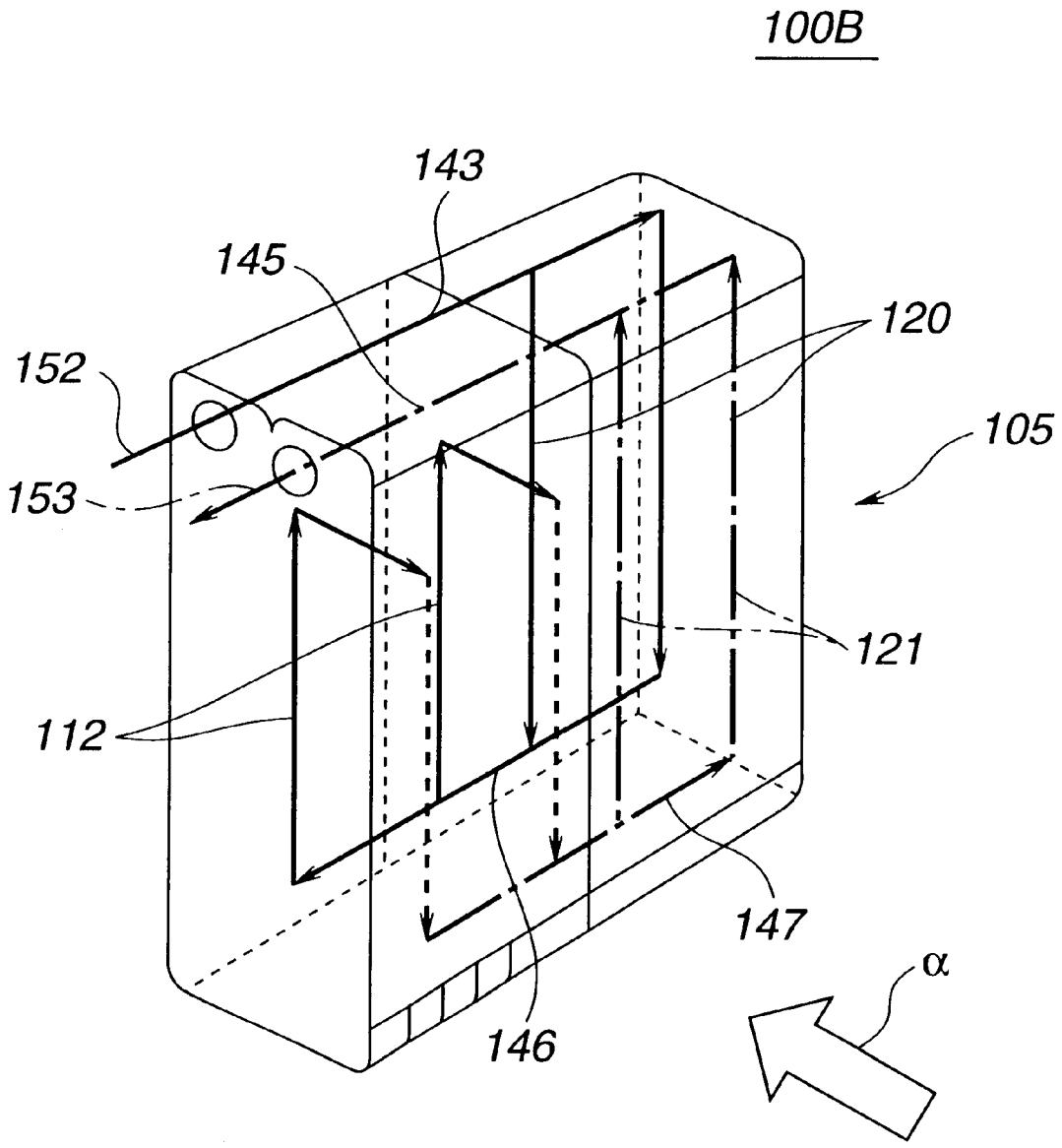
FIG. 16 is a schematic view of a second modification of the evaporator of the present invention, showing the path of refrigerant in the evaporator.
Figure 17:
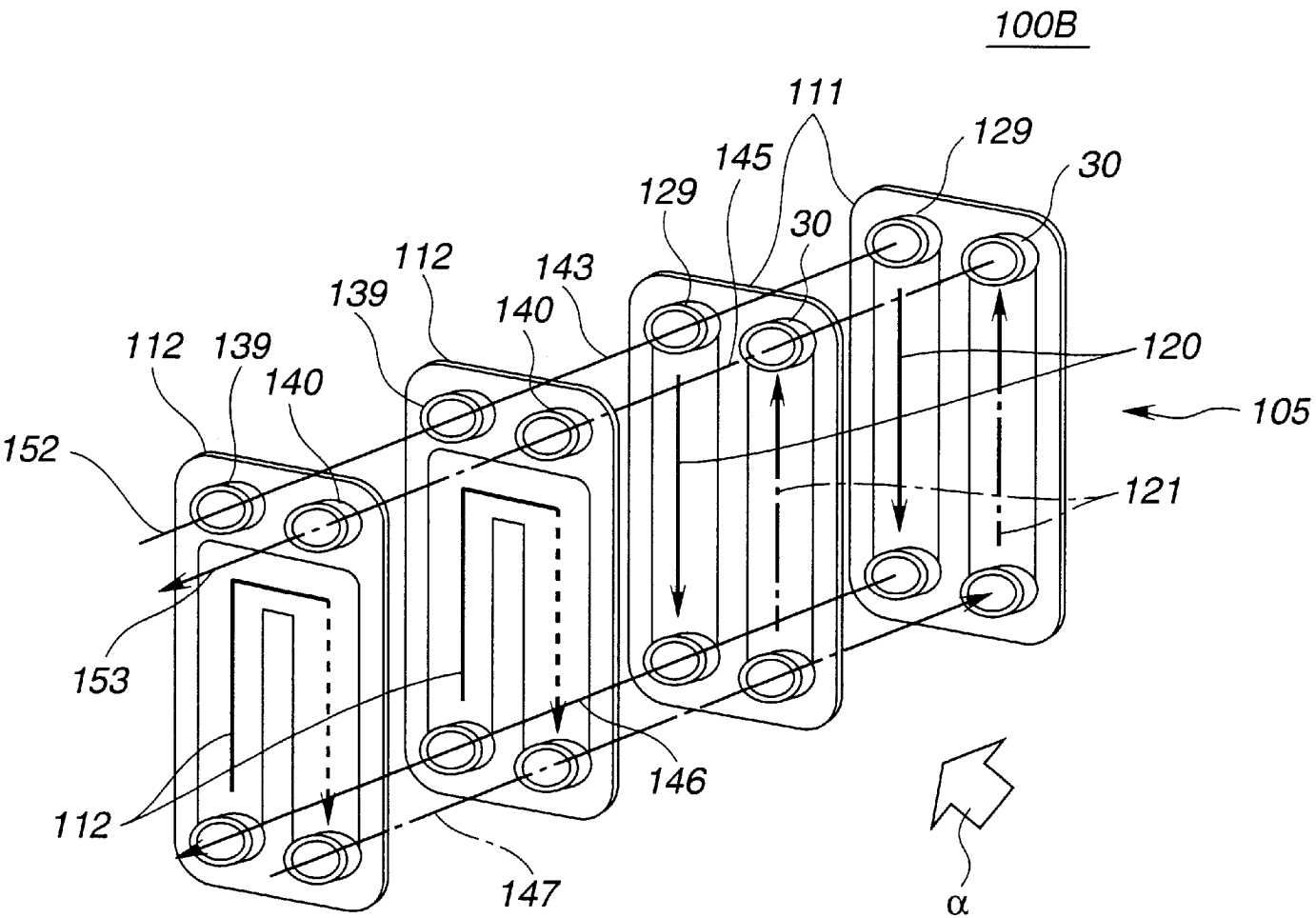
FIG. 17 is a schematic perspective view of the second modification of the evaporator of the invention.

As is seen from FIGS. 16 and 17, in this second modification 100B, refrigerant inlet and outlet pipes 152 and 153 are connected through a connector 154 (see FIG. 18) to an upper portion of one side end of the core unit 105. For this arrangement, the inlet tank portion 143 and the outlet tank portion 145 extend throughout the width of the core unit 105. That is, the first tank spaces 129 of the first heat exchanging elements 111 and the fifth tank spaces 139 of the second heat exchanging elements 112 are connected to constitute the inlet tank portion 143, and the second tank spaces 130 of the first heat exchanging elements 111 and the sixth tank spaces 140 of the second heat exchanging elements 112 are connected to constitute the outlet tank portion 145.

Figure 18:
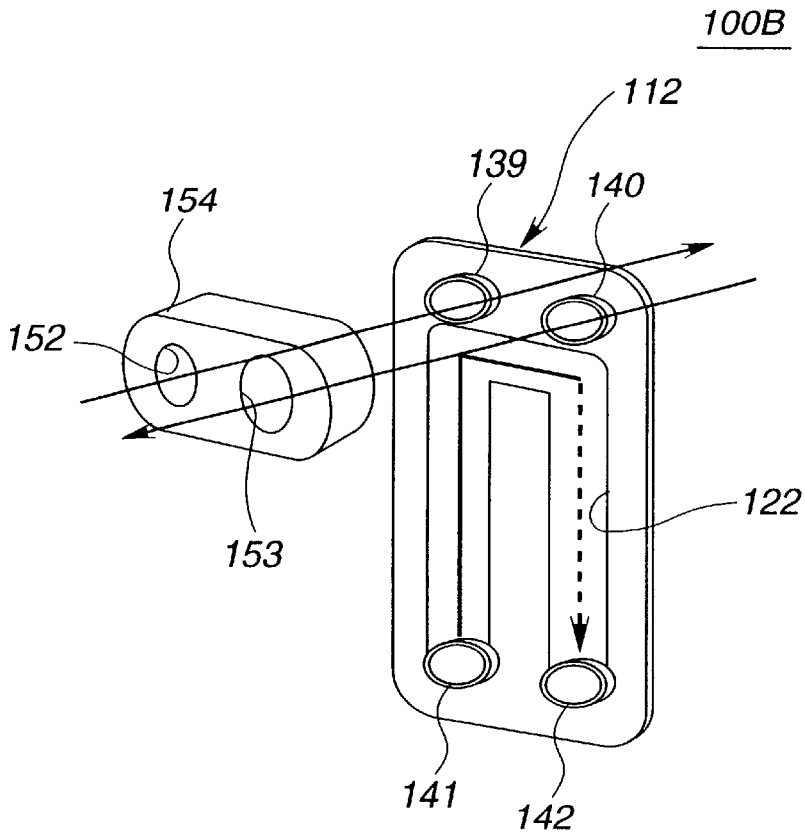
FIG. 18 is an exploded perspective view of one heat exchanging element and its associated connector structure, which are employed in the second modification of the evaporator of FIG. 17.
Figure 19:
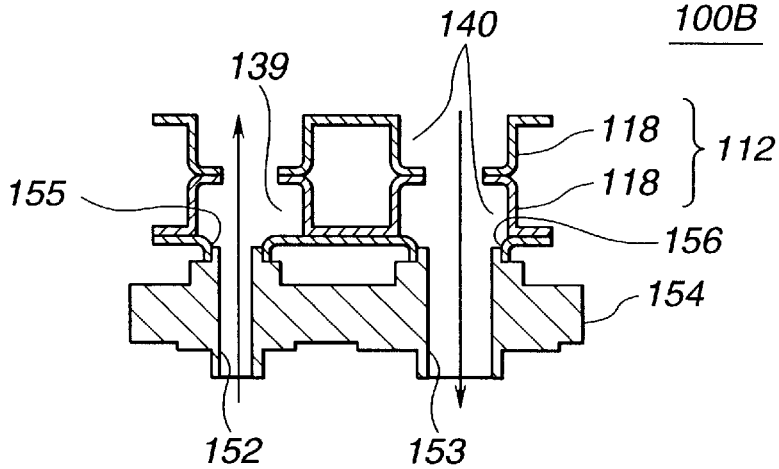
FIG. 19 is a sectional view of an assembled unit including the heat exchanging element and the associated connector structure of FIG. 18.

As is seen from FIGS. 18 and 19, the connector 154 is secured to the outermost one of the second heat exchanging elements 112. More specifically, as is seen from FIG. 19, the connector 154 is secured to the outside one of the paired recessed metal plates 118 of the element 112. For this connection, the outside metal plate 118 is formed with two openings 155 and 156 which are respectively communicated with the fifth tank spaces 139 and the sixth tank spaces 140 of the core unit 105. The inlet and outlet pipes 152 and 153 held by the connector 154 are respectively mated with the openings 155 and 156 of the outside metal plate 118. The inlet pipe 152 extends to an expansion valve and the outlet pipe 153 extends to a compressor.

Figure 20:
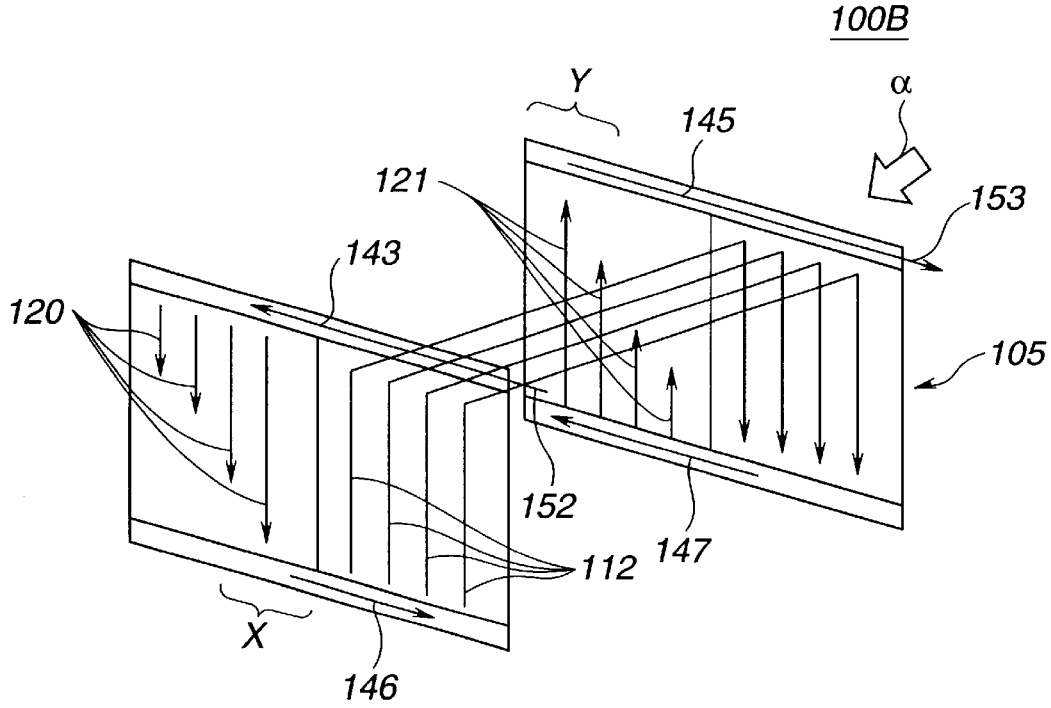
FIG. 20 is a view similar to FIG. 14, but showing the flow condition of refrigerant in the second modification of the evaporator of the invention.
Figure 21:
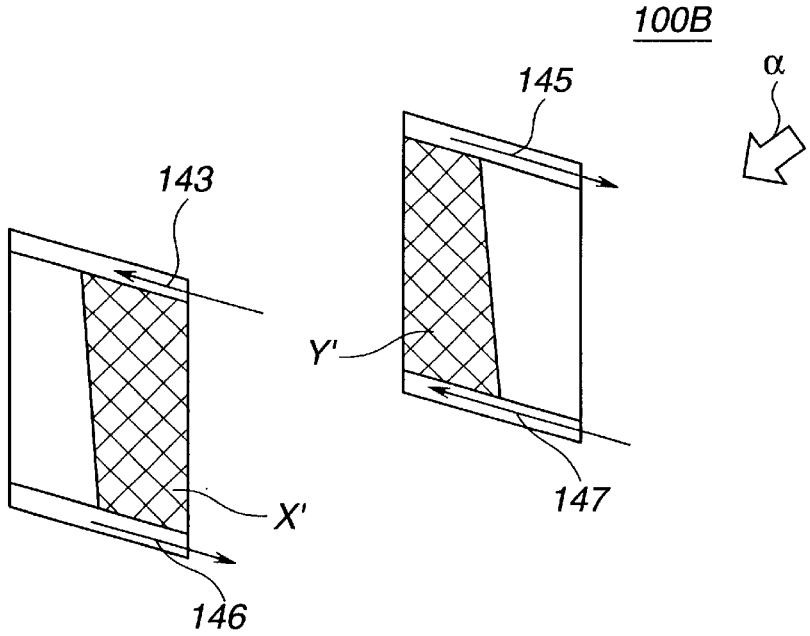
FIG. 21 is a view similar to FIG. 15, but showing a temperature distribution possessed by the second modification of the evaporator of the invention.

As is seen from FIGS. 20 and 21, also in this second modification 100B, under operation, the inside side section "X" of the air flow downstream left-half part of the evaporator 100B is permitted to let a larger amount of liquid-gaseous refrigerant flow therethrough, and the outside section "Y" of the air flow upstream left-half part of the evaporator 100B is permitted to let a larger amount of gaseous refrigerant flow therethrough. Like in the case of the above-mentioned evaporator 100, the two sections "X" and "Y" are not overlapped with respect to the direction in which the air "α" flows. That is, also in this second modification 100B, a relatively low temperature zone of the flow passages 120 and a relatively high temperature zone of the flow passages 121 are overlapped to each other with respect to the air flowing direction. Thus, the core unit 105 of the evaporator 100B can have an even temperature distribution therethroughout.

Furthermore, since, in this second modification 100B (see FIG. 20), the inlet and outlet pipes 152 and 153 are aligned with the inlet and outlet tank portions 143 and 145 of the core unit 105, the inflow of the refrigerant into the inlet tank portion 143 and the outflow of the refrigerant from the outlet tank portion 145 are smoothly carried out and thus the refrigerant flow resistance of the evaporator 100B can be reduced.

Figure 22:
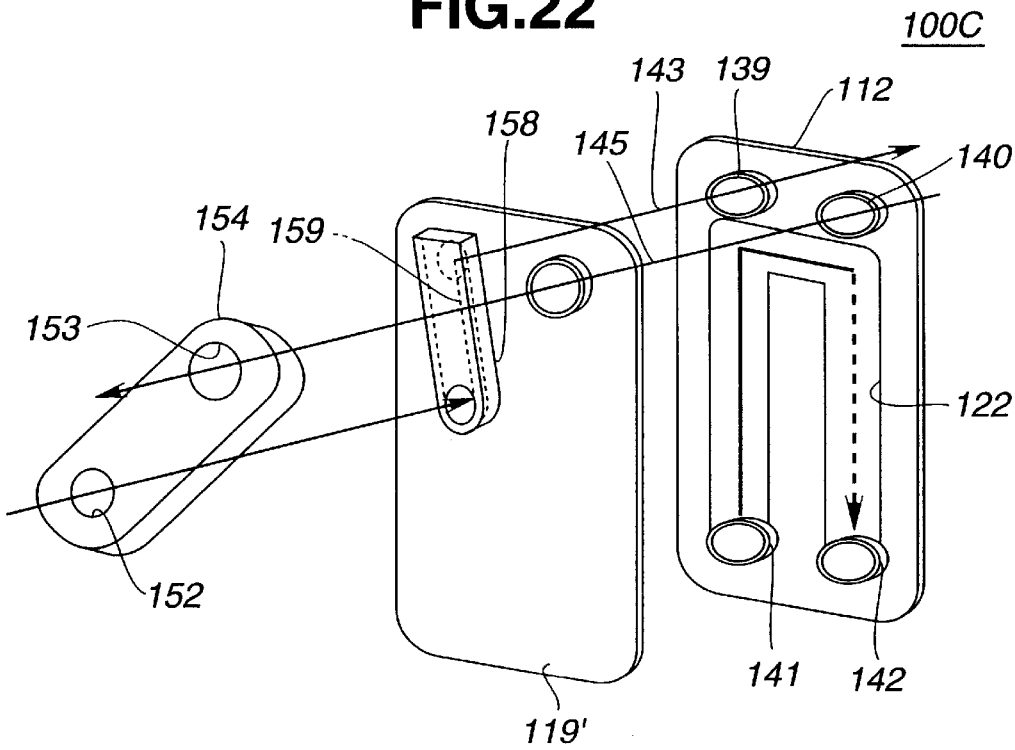
FIG. 22 is a view similar to FIG. 18, but showing a third modification of the evaporator of the invention.

Referring to FIG. 22, there is shown a third modification 100C of the evaporator 100.

Since this modification 100C is similar in construction to the above-mentioned second modification 100B, only parts different from those of the second modification 100B will be described.

That is, as is shown in the drawing, a side plate 119' provided with an extra side tank 158 is employed for reducing the dynamic pressure possessed by the refrigerant just fed to the core unit 105. As shown, a passage 159 defined in the extra side tank 158 has one end connected to the inlet tank portion 143 and the other end connected to the refrigerant inlet pipe 152. In this case, the dynamic pressure possessed by the refrigerant just fed to the core unit 105 is effectively reduced and thus undesired drift of the refrigerant flow in the flow passages 120 of the first heat exchanging elements 111 is suppressed or at least minimized. Even in this modification 100C, the refrigerant outlet pipe 153 should be aligned with the outlet tank portion 145 because the gaseous refrigerant flowing in the outlet tank portion 145 is easily affected in flow resistance by the complication in structure of the flow passage as compared with the liquid-gaseous refrigerant fed into the core unit 105.

Figure 23:
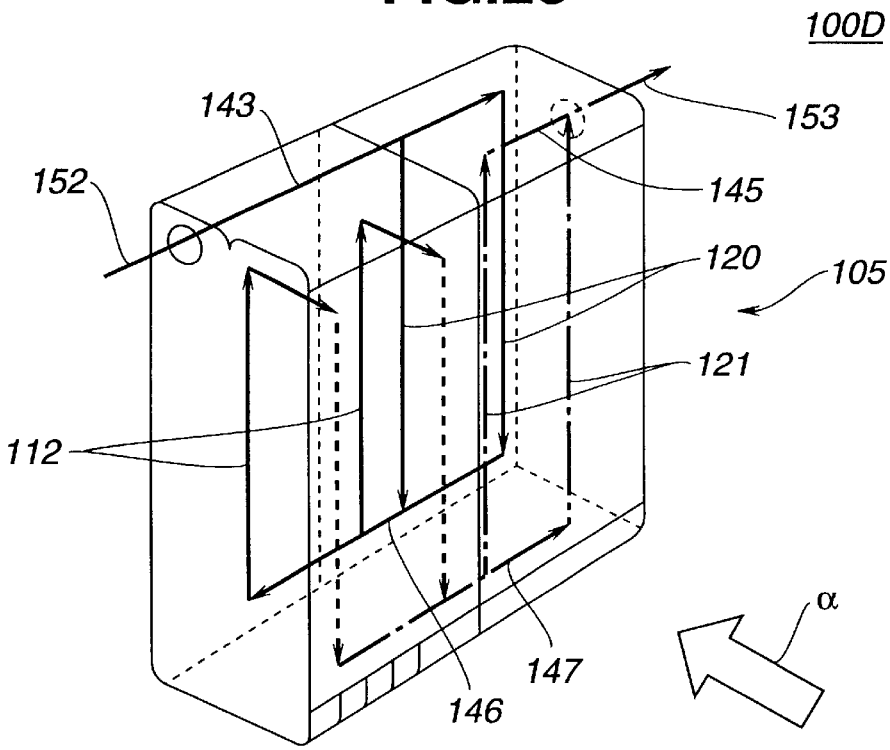
FIG. 23 is a view similar to FIG. 16, but showing a fourth modification of the evaporator of the present invention.
Figure 24:
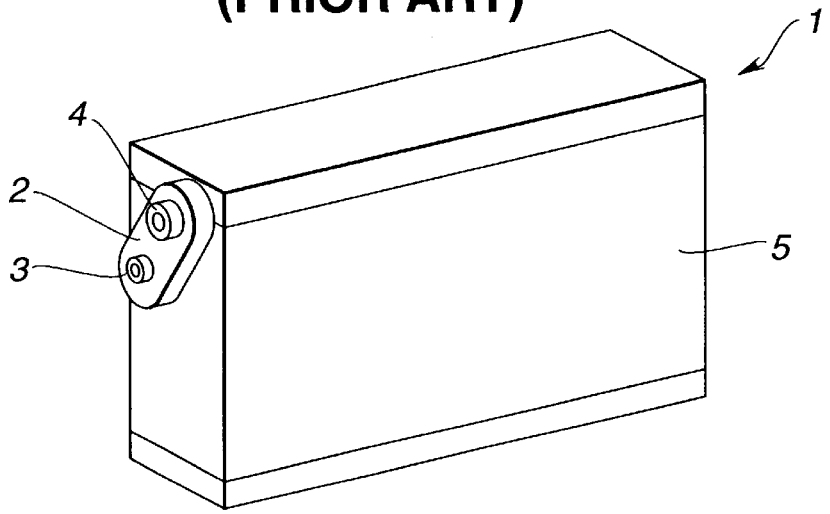
FIG.24 (PRIOR ART)
FIG. 24 is a perspective view of a first conventional evaporator.
Figure 25:
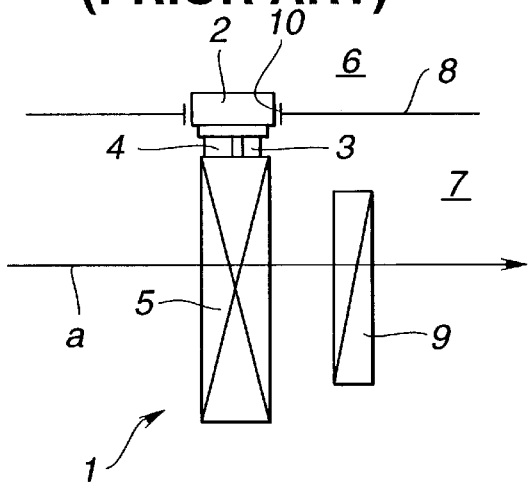
FIG.25 (PRIOR ART)
FIG. 25 is a plan view of a part of a motor vehicle where the first conventional evaporator associated with an air conditioner is operatively arranged.
Figure 26:
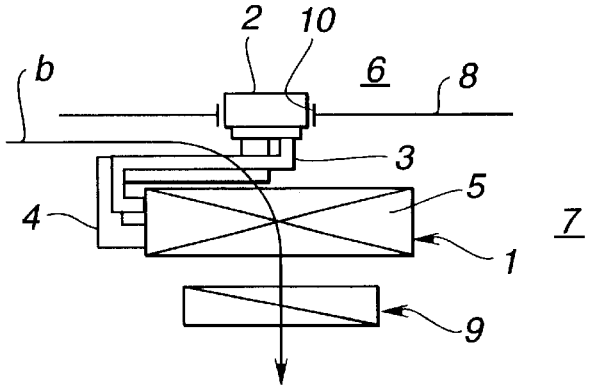
FIG.26 (PRIOR ART)
FIG. 26 is a view similar to FIG. 25, but showing a drawback which is possessed by the first conventional evaporator when the same is arranged in a different way.
Figure 27:
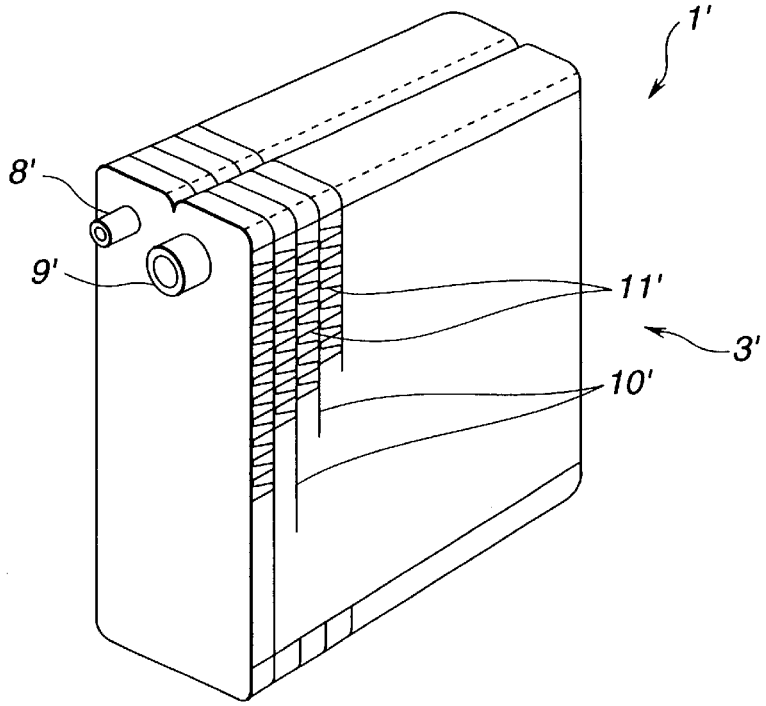
FIG.27 (PRIOR ART)
FIG. 27 is a perspective view of a second conventional evaporator.

Referring to FIG. 23, there is shown a third modification 100D of the evaporator 100.

As shown, in this fourth modification 100D, refrigerant inlet and outlet pipes 152 and 153 are connected to laterally opposed ends of the core unit 105. Furthermore, in this modification 100D, the outlet tank portion 145 is provided at only one half part of the core unit 105. That is, the second tank spaces 130 of the first heat exchanging elements 111 located at a right half (as viewed in FIG. 23) of the core unit 105 are connected to constitute the outlet tank portion 145.

The entire contents of Japanese Patent Application P10-317145 (filed Nov. 9, 1998) and Japanese Patent Application P11-189273 (filed Jul. 2, 1999) are incorporated herein by reference.

Although the invention has been described above with reference to an embodiment of the invention and modifications of the same, the invention is not limited to such the embodiment and modifications as described above. Much larger modifications and variations of the invention described above will occur to those skilled in the art, in light of the above teachings.

What is claimed is:

1. A stack type evaporator comprising:

a first mass including first heat exchanging elements, each first heat exchanging element having mutually independent first and second passages;

a second mass including second heat exchanging elements, each second heat exchanging element having a generally U-shaped third passage which has first and second ends and a pair of mutually independent tank passages for respective fluid communication with said first and second passages, said second mass being arranged beside said first mass in such a manner that the first and second heat exchanging elements are aligned on a common axis;

an inlet tank passage connecting to upper ends of said first passages;

an upstream tank passage connecting to lower ends of said first passages and the first ends of said third passages;

a downstream tank passage connecting to lower ends of said second passages and the second ends of said third passages;

an outlet tank passage connecting to upper ends of said second passages;

an inlet pipe connected to said inlet tank passage; and an outlet pipe connected to said outlet tank passage.

2. A stack type evaporator as claimed in claim 1, in which said first and second passages of each first heat exchanging element are arranged at downstream and upstream positions with respect to a direction in which air flows through the evaporator, and in which said third passage of each second heat exchanging element comprises a first passage part, a second passage part and a third passage part through which said first and second passage parts are connected, said first and second passage parts being arranged at downstream and upstream positions with respect to the air flowing direction.

3. A stack type evaporator as claimed in claim 2, in which said first passages of the first heat exchanging elements and said first passage parts of the second heat exchanging elements are arranged to form a first line, and in which said second passages of the first heat exchanging elements and said second passage parts of the second heat exchanging elements are arranged to form a second line, said second line being positioned more upstream than said first line with respect to the air flowing direction.

4. A stack type evaporator as claimed in claim 3, in which said inlet pipe is connected to the upper end of the first passage possessed by the innermost first heat exchanging element, and in which said outlet pipe is connected to the upper end of the second passage possessed by said innermost first heat exchanging element.

5. A stack type evaporator as claimed in claim 4, in which said inlet and outlet pipes are projected in a direction against the air flowing direction.

6. A stack type evaporator as claimed in claim 5, in which said inlet and outlet pipes are connected to the upper ends of said first and second passages through respective connectors.

7. A stack type evaporator as claimed in claim 5, in which said inlet and outlet pipes are connected to the upper ends of said first and second passages through respective first and second connectors, said first connector having a passage by which said inlet pipe is connected to the upper end of said first passage, said second connector having a passage by which said outlet pipe is connected to the upper end of said second passage.

8. A stack type evaporator as claimed in claim 3, in which said inlet tank passage extends to the outermost second heat exchanging element, in which said inlet pipe is connected to the extended intake tank passage possessed by said outermost second heat exchanging element, and in which said outlet pipe is connected to the upper end of the second passage possessed by the outermost first heat exchanging element.

9. A stack type evaporator as claimed in claim 3, in which said inlet and outlet tank passages extend to the outermost second heat exchanging element, and in which said inlet and outlet pipes are respectively connected to the extended inlet and outlet tank passages possessed by said outermost second heat exchanging element.

10. A stack type evaporator as claimed in claim 9, in which said inlet and outlet pipes are aligned with said inlet and outlet tank passages, respectively.

11. A stack type evaporator as claimed in claim 10, in which said outermost second heat exchanging element is provided with a connector through which said inlet and outlet pipes are connected to said inlet and outlet tank passages.

12. A stack type evaporator as claimed in claim 11, in which said outermost second heat exchanging element is provided further with an extra side tank for reducing a dynamic pressure possessed by a refrigerant just fed into the inlet tank passage from said inlet pipe.

13. A stack type evaporator as claimed in claim 12, in which said extra side tank has therein a passage which has one end connected to the inlet tank passage and the other end connected to said inlet pipe held by said connector.

14. A stack type evaporator as claimed in claim 3, in which said inlet tank passage extends to the outermost second heat exchanging element, in which said inlet pipe is connected to the extended intake tank passage possessed by said outermost second heat exchanging element, and in which said outlet pipe is connected to the upper end of the second passage possessed by the outermost first heat exchanging element.

15. A stack type evaporator as claimed in claim 1, further comprising:

first and second side plates respectively attached to outside ones of the heat exchanging elements of said first and second masses; and a plurality of heat radiation fins each being interposed between adjacent two of the first and second heat exchanging elements.

16. A stack type evaporator as claimed in claim 1, in which each of said first and second heat exchanging elements comprises two identical recessed metal plates, said two metal plates being coupled in a face-to-face connecting manner to define therebetween a hermetically sealed liquid flow space.

17. In a motor vehicle having an engine room and a passenger room which are partitioned by a dash panel, an arrangement comprising:

an evaporator which includes a first mass including first heat exchanging elements, each first heat exchanging element having mutually independent first and second passages;

a second mass including second heat exchanging elements, each second heat exchanging element having a generally U-shaped third passage which has first and second ends and a pair of mutually independent tank passages for respective fluid communication with said first and second passages, said second mass being arranged just beside said first mass in such a manner that the first and second heat exchanging elements are aligned on a common axis;

an inlet tank passage connecting to upper ends of said first passages;

an upstream tank passage connecting to lower ends of said first passages and the first ends of said third passages;

a downstream tank passage connecting to lower ends of said second passages and the second ends of said third passages;

an outlet tank passage connecting to upper ends of said second passages;

an inlet pipe connected to said inlet tank passage; and an outlet pipe connected to said outlet tank passage;

means for placing said evaporator in such a manner that the evaporator is arranged in parallel with said dash panel and that said inlet tank passage and said upstream tank passage are positioned away from said dash panel as compared with said outlet tank passage and said downstream tank passage; and means for producing an air flow through said evaporator in a direction from said dash panel toward said evaporator.

* * * * *